US005577929A

United States Patent [19]

Sawada

[11] Patent Number: 5,577,929

[45] Date of Patent: Nov. 26, 1996

[54] BULB SOCKET

[75] Inventor: Hisashi Sawada, Yokkaichi, Japan

[73] Assignee: Sumitomo Wiring Systems, Ltd., Yokkaichi, Japan

[21] Appl. No.: 325,584

[22] Filed: Oct. 19, 1994

[30] Foreign Application Priority Data

Oct. 26, 1993 [JP] Japan ..... 5-291291

[51] Int. Cl.[6] ..... H01R 4/50

[52] U.S. Cl. ..... 439/336; 439/548

[58] Field of Search ..... 439/671, 672, 439/673, 674, 335, 336, 546, 547, 548

[56] References Cited

U.S. PATENT DOCUMENTS 2,741,747 4/1956 Woofter ..... 439/671
5,320,553 6/1994 Ogawa et al. ..... 439/336

FOREIGN PATENT DOCUMENTS 774713 12/1934 France ..... 439/671
61-96684 5/1986 Japan .

*Primary Examiner*—Neil Abrams
*Assistant Examiner*—Yong Kim
*Attorney, Agent, or Firm*—Oliff & Berridge

[57] ABSTRACT

A bulb socket mounted on a partition wall of a lamp house through an elastic gasket, for receiving a bulb and electric terminals, comprises a front casing and a rear casing. The front casing which is receiving a proximal end portion of the bulb has engagement projections on an outer periphery thereof. The rear casing has a mounting flange on an outer periphery thereof for holding the partition wall of the lamp house with the engagement projections of the front casing. The rear casing is molded separately from the front casing by a mold which allows the rear casing to be removed therefrom in an axial direction. The front casing and the rear casing are integrally joined at their open end surfaces.

9 Claims, 3 Drawing Sheets

BULB SOCKET

BACKGROUND OF THE INVENTION

1. Field of the Invention

This invention relates to a bulb socket for being attached to a lamp house.

2. Description of Prior Art

As shown in FIGS. 5 and 6, a socket casing 50 of one conventional bulb socket is integrally molded of a resin, and includes a tubular socket portion 51 for receiving a bulb, and a tubular connector portion 52 extending from this socket portion.

An outwardly-extending, mounting flange 53 of a larger diameter is formed on an outer peripheral surface of the socket casing 50 at the boundary between the socket portion 51 and the connector portion 52. And engagement projections 54 are formed on the outer peripheral surface of the socket portion. A plate-like finger support 56 is formed on and projected from the outer peripheral surface of the connector portion 52.

For attaching the bulb socket of this construction to a lamp house, the socket portion 51 is passed through a mounting hole 61 formed through a partition wall 60 of the lamp house, with a gasket 62 of an elastic material interposed between the mounting side of the mounting flange 53 and the partition wall, thus compressing the gasket 62 hard, and in this condition the socket is turned by putting the finger on the finger support portion 56, so that the partition wall 60 is held between the engagement projections 54 and the partition wall 60. The gasket 62 is elastically pressed against the partition wall 60 and the mounting flange 53, thereby imparting waterproofness to the interior of the lamp house.

The mounting flange 53, extending over the entire circumference, and the plurality Of engagement projections 54 need to be formed on the outer periphery of this conventional socket casing in axially spaced relation to each other. Therefore, it is difficult to remove the socket casing 50 from a mold in the axial direction, and therefore the socket casing is molded by a molding method in which the socket casing is removed from the mold in a direction perpendicular to the axis thereof, which mold can be split into halves in the axial direction.

As a result, as shown in an exaggerated manner in FIGS. 5 and 6, axially-extending, linear protuberances, called parting lines P, are formed respectively on upper and lower portions of the outer periphery of the socket casing 50. These raised parting lines P extend across a press surface of the mounting flange 53 which is pressed against the gasket 62, and therefore the gasket 62 can not be held in intimate contact with the mounting flange along the parting lines P, thus inviting a problem that the sealing performance achieved by the gasket 62 is affected.

For attaching a bulb to the bulb socket, a mounting groove 63, called a J-slot, is formed in the inner peripheral surface of the socket portion. This J-slot 63 has an axially-extending insertion groove 63*a*, and an engagement groove 63*b* extending laterally perpendicularly from a distal end of the insertion groove 63*a*. One side surface of the engagement groove 63*b* disposed at the insertion side serves as an engagement portion 63*c*. In order to form the J-slot 63 having the laterally perpendicularly-extending engagement groove 63*b*, a complicated molding method as disclosed in Japanese Patent Unexamined Publication No. 61-96684 must be used.

It is therefore an object of the present invention to provide a bulb socket which has a good sealing performance.

It is another object of the invention to provide a bulb socket which can be produced by a mold of a simple construction.

SUMMARY OF THE INVENTION

In order to achieve the object, the invention provides a bulb socket mounted on a partition wall of a lamp house through an elastic gasket, for receiving a bulb and electric terminals, the bulb socket comprising a front casing and a rear casing. The front casing which is receiving a proximal end portion of the bulb has engagement projections on an outer periphery thereof. The rear casing has a mounting flange on an outer periphery thereof for holding the partition wall of the lamp house with the engagement projections of the front casing. The rear casing is molded separately from the front casing by a mold which allows the front casing to be removed therefrom in an axial direction. The front casing and the rear casing are integrally joined at their open end surfaces.

In order to achieve further object, the invention provides a bulb socket wherein the front casing, molded separately from the rear casing, is removed from an associated mold in an axial direction, and a J-slot is formed in an inner surface of the front casing, and the J-slot is formed by an insertion groove and a engagement groove which axially linearly extend respectively from left and right open ends of the front casing in offset relation to each other, and a mounting pin projected from an outer periphery of the bulb is received in the J-slot, and then the bulb is turned so as to retainingly engage the mounting pin in the J-slot.

The socket casing is formed by molding the front casing and the rear casing separately from each other. The mounting flange is formed on the outer surface of the rear casing over the entire circumference, and is projected in a direction perpendicular to the axial direction. There is no obstructive portion which prevents the removal of the front casing from the mold in the axial direction, and therefore the front casing can be molded by a molding method in which the front casing is allowed to be removed from the mold in the axial direction. Therefore, an axially-extending, parting line is not formed on the outer surface of the rear casing, and when the bulb socket, formed by integrally joining the rear casing and the front casing together, is mounted on a partition wall of a lamp house, a gasket is held in intimate contact with the mounting flange over the entire peripheral portion, thereby achieving a sealing effect.

The J-slot can be formed by the insertion groove and the engagement groove which axially linearly extend respectively from the left and right open ends of the front casing in offset relation to each other, and therefore the front casing can be molded by a mold of a simple construction.

As described above, according to the invention, the front casing and the rear casing are molded separately from each other, and the two casings are integrally joined together at their open end surfaces. Therefore, the rear casing can be molded by the mold of a simple construction which can be split in the axial direction. As a result, a radially-extending parting line is not formed on the sealing surface of the mounting flange, thereby providing the bulb socket having an excellent sealing performance.

Furthermore, the J-slot can be formed by the insertion groove and the engagement groove which axially linearly extend respectively from the left and right open ends of the front casing in offset relation to each other, and therefore the front casing can be molded by the mold of a simple construction.

DETAILED DESCRIPTION OF THE PREFERRED EMBODIMENTS

One preferred embodiment of the present invention will now be described with reference to the drawings.

Figure 1:
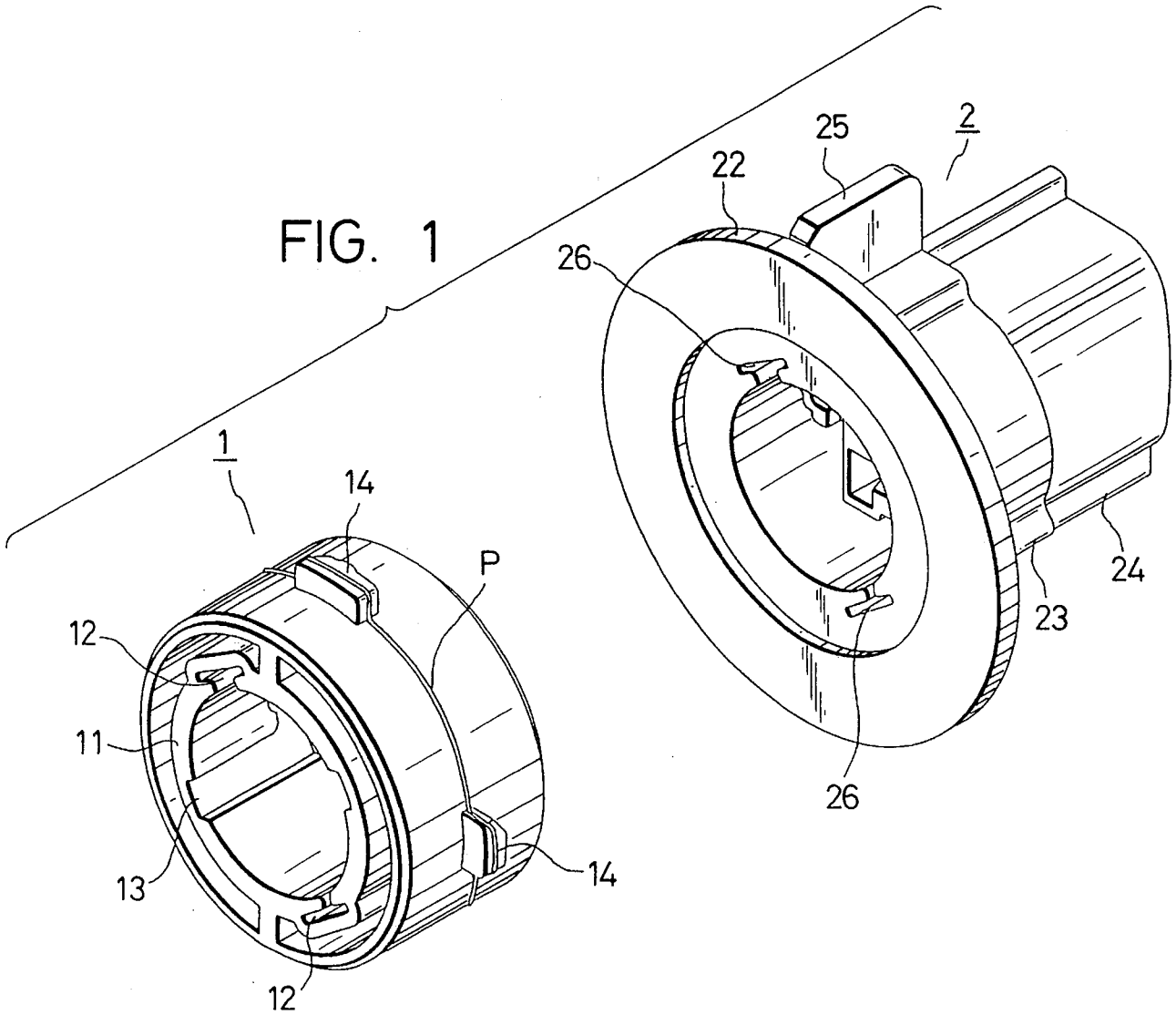
FIG. 1 is a perspective view of a socket casing in a separated condition.
Figure 2:
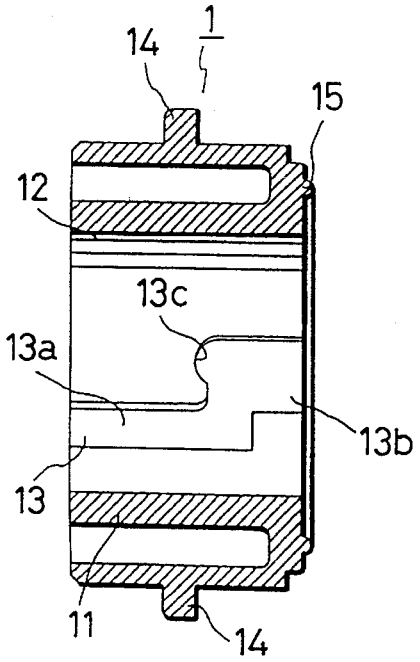
FIG. 2 is a vertical cross-sectional view of a front casing.

As shown in FIG. 1, a socket casing of this embodiment includes a front casing 1 and a rear casing 2 which are separately molded of a resin by respective molds. The front casing 1 is of a double-tube construction, and two insertion grooves 12 of a generally T-shaped cross-section (in which feeder terminals (not shown) for connection to a base of a bulb are mounted) are symmetrically formed in an inner surface of an inner tube 11. As shown in FIG. 2, each insertion groove 12 extends linearly between opposite (right and left) open ends of the inner tube. A J-slot 13 for the purpose of attaching the bulb is formed in the inner peripheral surface of the inner tube 11 at a position angularly spaced about 90° from the insertion grooves 12. As shown in FIG. 2, the J-slot 13 has an insertion groove 13*a* extending linearly inwardly from the left open end, and a engagement groove 13*b* extending linearly from the right open end, the two grooves 13*a* and 13*b* being continuous with each other in an offset manner. This offset portion provides a retaining portion 13*c* extending perpendicularly from the distal end of the insertion groove extending linearly from the left open end.

Four engagement projections 14 are formed on the outer peripheral surface of the front casing 1, and are spaced circumferentially at generally equal intervals. An annular welding projection 15 is formed on the right open end surface in surrounding relation to the end opening.

The front casing 1 is formed by a mold which is split into right and left portions at a region where the engagement projections 14 are formed, and allows the removal of the molded casing in the axial direction. The front casing 1 has no portion which must be removed from the mold in a direction perpendicular to the axial direction, and therefore the front casing is molded by the mold of a simple construction. Therefore, even though a parting line is formed at the mating surface between the right and left mold portions, this parting line extends from the engagement projections 14 in a direction perpendicular to the axis, as shown in an exaggerated manner in FIG. 1.

Figure 3:
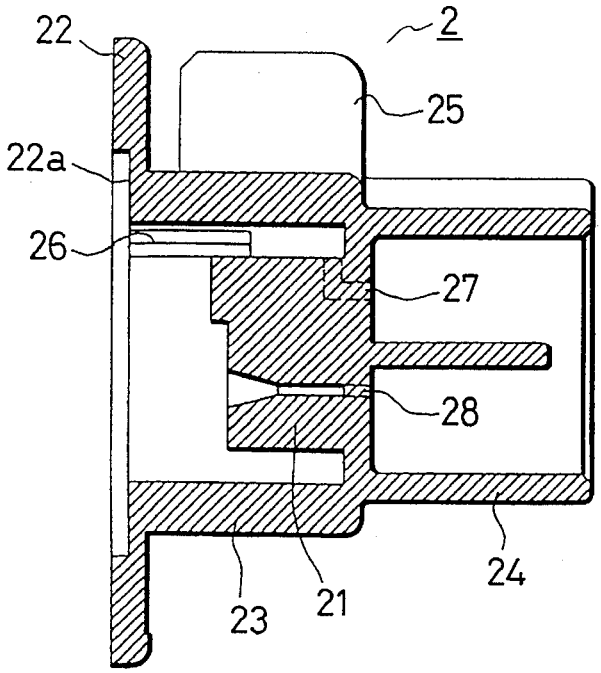
FIG. 3 is a vertical cross-sectional view of a rear casing.
Figure 6:
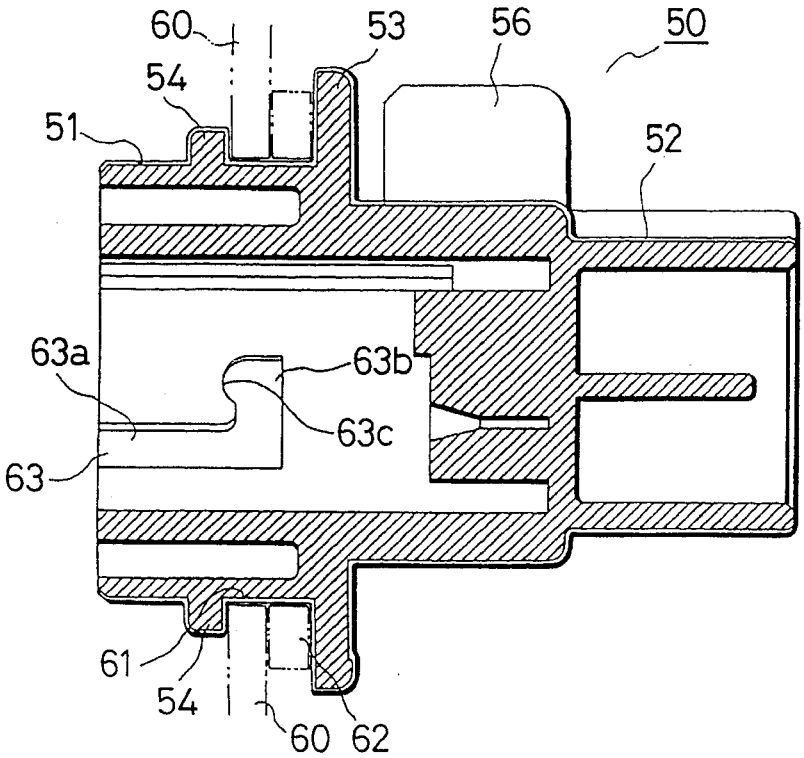
FIG. 6 is a vertical cross-sectional view of the conventional socket casing.

As shown in FIG. 3, the rear casing 2 comprises a tube having a partition wall 21 formed therein, and a mounting flange 22 of a larger diameter is formed on an outer periphery of the rear casing at a left open end thereof. A left half 23 of the tube having the mounting flange 22 is equal in inner diameter to the front casing 1, and a right tube half 24 is formed into a hood-like structure for receiving a female connector (not shown). A plate-like finger support 25 is formed on and projected from the outer periphery of the rear casing 2, and extends in the axial direction.

Insertion grooves 26 are formed axially in the inner peripheral surface of the tube half 23, and are continuous respectively with the insertion grooves 12 in the front casing 1, and have the same cross-sectional shape as that of the insertion grooves 12. Each feeder terminal is inserted into the associated insertion groove 26 through the associated insertion groove 12, and extends through an insertion hole 27, formed through the partition wall 21, into the tube half 24, so that the distal end portion of the feeder terminal extending into the tube half 24 serves as a male metal terminal. Also formed through the partition wall 21 is an insertion hole 28 into which a male metal terminal, connected to an end of a spring (not shown) resiliently urging a contact of the bulb, is inserted. In this connector portion, the male metal terminals are projected respectively through the two insertion holes 27 and 28, and are to be fitted respectively on female metal terminals (not shown).

A peripheral edge portion of the left open end of the rear casing 2 is slightly recessed from the surface of the mounting flange 22 to provide a joint surface 22*a* which is joined to the welding projection 15.

The rear casing 2 is formed by a mold which is split into right and left portions, with a mating surface disposed at the left surface of the mounting flange 22, and allows the removal of the molded casing in the axial direction. Except for a narrow portion between the mounting flange 22 and the finger support 25, the rear casing 2 has no portion which must be removed from the mold in a direction perpendicular to the axial direction, and therefore the rear casing can be molded by the mold of a simple construction. Therefore, a parting line will not be formed on the left surface of the mounting flange 22 by the mating surface between the right and left portions of the mold for molding the rear casing 2.

Figure 4:
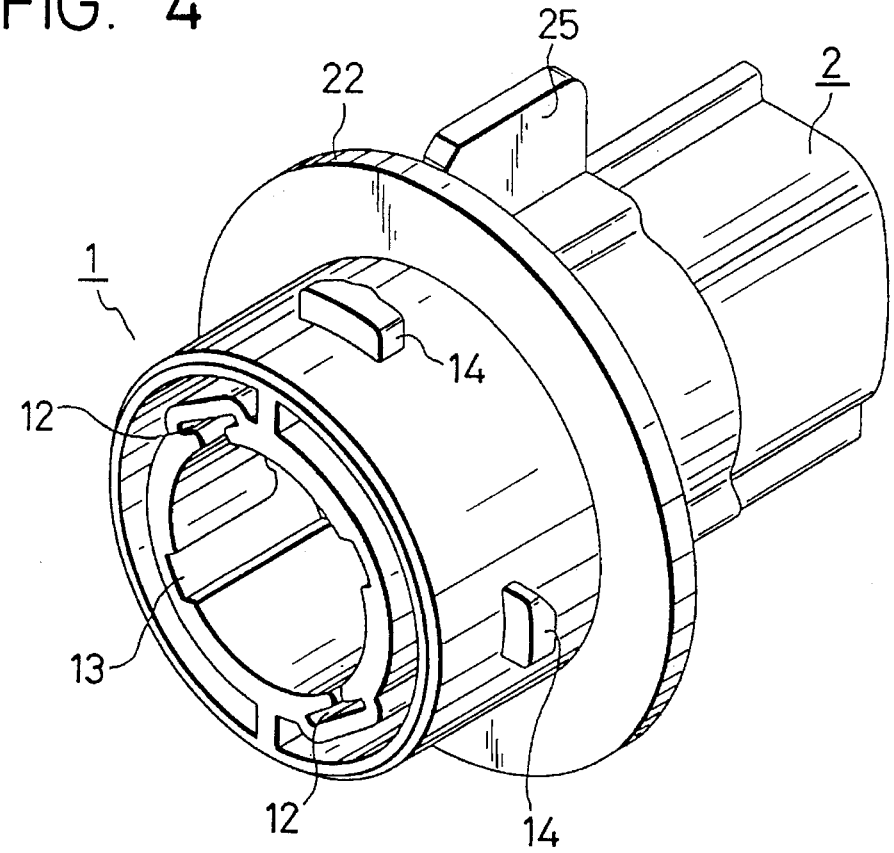
FIG. 4 is a perspective view of the socket casing.
Figure 5:
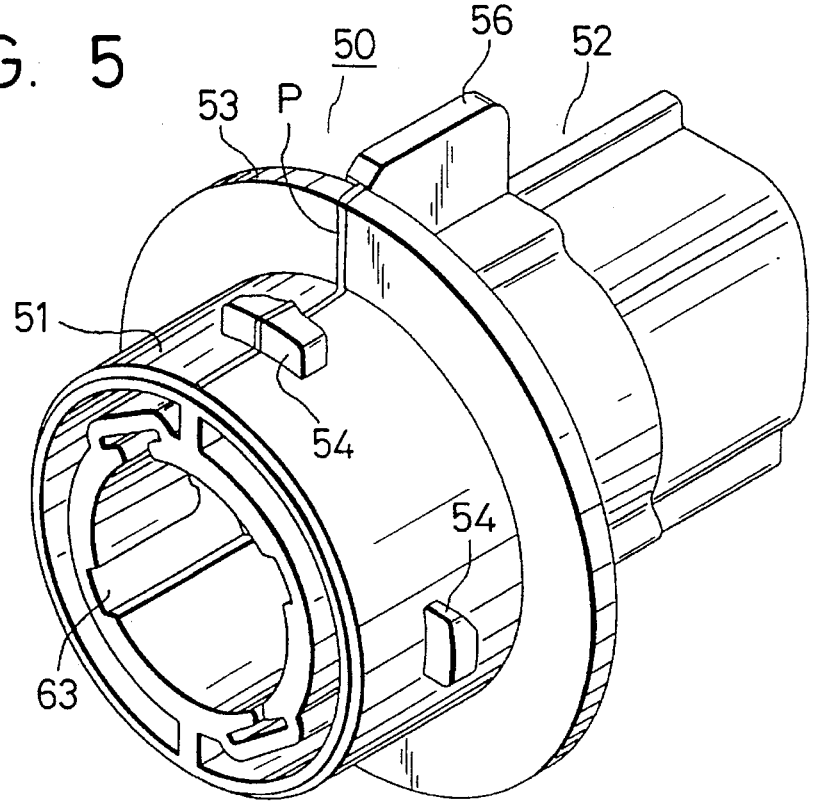
FIG. 5 is a perspective view of a conventional socket casing.

The front casing 1 and the rear casing 2 are thus molded separately from each other, and the insertion grooves 12 are aligned with the insertion grooves 26, respectively, and the welding projection 15 of the front casing is abutted against the joint surface 22*a* of the rear casing, and then is fusingly bonded thereto by heating, thereby forming the socket casing of an integral construction shown in FIG. 4.

Thereafter, the feeder terminals and so on are inserted and attached to provide the bulb socket. For attaching the thus formed bulb socket of this embodiment to a partition wall of a lamp house, the parting line P as in the conventional construction is not formed on the mounting flange 22 pressed against a gasket, and therefore the gasket can be attached to the mounting flange 22 in intimate contact therewith, thereby achieving a sealing effect.

In this embodiment, not only the rear casing 2 but also the front casing 1 are formed by the respective molds of the right-left split type, and therefore the J-slot can be formed by the insertion groove 13*a* and the engagement groove 13*b* which linearly extend respectively from the left and right open ends in offset relation to each other in the tube, and therefore there is no need to use a mold of a complicated construction as disclosed in Japanese Patent Unexamined Publication No. 61-96684, and the molding can be carried out using the molds of a simple construction.

What is claimed is:

1. A bulb socket mounted on a partition wall of a lamp house through an elastic gasket, for receiving a bulb and electrical terminals, said bulb socket comprising:

a front casing for receiving a proximal end portion of the bulb, said front casing having engagement projections on an outer periphery of said front casing; and a rear casing having a mounting flange on an outer periphery of said rear casing, said rear casing being molded separately from said front casing whereby said front casing is shaped to permit removal from a mold in an axial direction, and being integrally joined with said front casing at open end surfaces, said mounting flange shaped to hold the partition wall of the lamp house with said engagement projections of said front casing.

2. A bulb socket according to claim 1, wherein said front casing form by a mold which allows said front casing to be removed from an associated mold in an axial direction.

3. A bulb socket according to claim 2, wherein a front casing further includes a J-slot formed in an inner surface of said front casing, said J-slot being defined by an insertion groove and a engagement groove which axially linearly extend respectively from left and right open ends of said front casing in offset relation to each other, said J-slot for receiving a mounting pin projected from an outer periphery of the bulb in said J-slot and for retainingly engaging the mounting pin.

4. A bulb socket comprising a tubular front casing for receiving a proximal end portion of a bulb, and a tubular rear casing having feeder terminals mounted therein, said feeder terminals feeding electric power to said bulb, wherein engagement projections for mounting purposes are formed on an outer periphery of said front casing; a mounting flange is formed on an outer periphery of said rear casing; and said bulb socket is mounted on a partition wall of a lamp house in such a manner that said partition wall is held between said engagement projections and said mounting flange through an elastic gasket;

wherein said rear casing is molded separately from said front casing whereby said front casing is shaped to permit removal from a mold in an axial direction; and said two casings are integrally joined together at open end surfaces.

5. A bulb socket according to claim 4, in which said front casing, molded separately from said rear casing, is removed from an associated mold in an axial direction.

6. A bulb socket according to claim 5, in which a J-slot is formed in an inner surface of said front casing, said J-slot is formed by an insertion groove and a engagement groove which axially linearly extend respectively from left and right open ends of said front casing in offset relation to each other, wherein a mounting pin projected from an outer periphery of said bulb is received in said J-slot, and then the bulb is turned so as to retainingly engage said mounting pin in said J-slot.

7. The bulb socket of claim 1, wherein said front casing has parting lines only circumferentially to a longitudinal axis of said front casing at its outer periphery on said engagement projections.

8. The bulb socket of claim 4, wherein said front casing has parting lines only circumferentially to a longitudinal axis of said front casing at its outer periphery on said engagement projections.

9. A method of molding a bulb socket including a front casing and a rear casing, comprising separately molding said front casing from said rear casing by steps of separately forming said front casing in a mold and removing said front casing from said mold in a direction along a longitudinal axis of said front casing.

* * * * *